US007059838B2

(12) United States Patent
Draskovits et al.

(10) Patent No.: US 7,059,838 B2
(45) Date of Patent: Jun. 13, 2006

(54) CONTROL DEVICE FOR POSITIVE DISPLACEMENT PUMPS

(75) Inventors: Günter Draskovits, Schwäbisch Gmünd (DE); Gerhard Zimmermann, Schwäbisch Gmünd (DE)

(73) Assignee: ZF Lenksysteme GmbH, Schwaebisch Gmuend (DE)

( * ) Notice: Subject to any disclaimer, the term of this patent is extended or adjusted under 35 U.S.C. 154(b) by 662 days.

(21) Appl. No.: 10/203,357

(22) PCT Filed: Jan. 30, 2001

(86) PCT No.: PCT/EP01/00955

§ 371 (c)(1),
(2), (4) Date: Oct. 15, 2002

(87) PCT Pub. No.: WO01/59301

PCT Pub. Date: Aug. 16, 2001

(65) Prior Publication Data

US 2003/0113216 A1 Jun. 19, 2003

(30) Foreign Application Priority Data

Feb. 11, 2000 (DE) ..... 100 06 140

(51) Int. Cl.
*F04B 49/00* (2006.01)
*F04B 39/10* (2006.01)

(52) U.S. Cl. ..... 417/297; 417/310; 417/441

(58) Field of Classification Search ..... 417/213, 417/310, 307, 441, 297; 251/120, 121; 137/565.36
See application file for complete search history.

(56) References Cited

U.S. PATENT DOCUMENTS 4,714,413 A * 12/1987 Duffy ..... 417/293
5,540,566 A * 7/1996 Ishizaki et al. ..... 417/297
5,651,665 A * 7/1997 Can et al. ..... 417/300
6,280,159 B1 * 8/2001 Agner et al. ..... 417/440
6,345,959 B1 * 2/2002 Spurry ..... 417/297

FOREIGN PATENT DOCUMENTS

| | | |
|---|---|---|
| DE | 2 230 306 | 4/1973 |
| DE | 38 37 182 | 5/1989 |
| DE | 43 17 880 | 12/1994 |

* cited by examiner

*Primary Examiner*—Charles G. Freay
(74) *Attorney, Agent, or Firm*—Kenyon & Kenyon

(57) ABSTRACT

A control device for a positive displacement pump includes a throttle device and a flow control valve. The flow control valve includes a flow control piston and is configured to regulate an unrequired excess flow of the pump at an increased speed. The throttle device is configured to produce a speed-related pressure differential in a bore section, the pressure differential being responsible for the displacement of the flow control valve and the throttle device. The throttle device is arranged in the pressure outlet (bore section) of the pump and includes a regulating pin connected to the flow control piston, having a control contour configured so that a modifiable through cross-section is created in association with a throttle bore. The control pin has a wider section in an axial displacement area of the throttle device, the area not being involved in control of the volume flow, whereby a minimum obturating section arises in the displacement area. This may result in accelerated movement of the flow control piston, which may result in quicker reaction of the control mechanism, thereby preventing an overshoot and overincrease in the flow capacity.

5 Claims, 1 Drawing Sheet

CONTROL DEVICE FOR POSITIVE DISPLACEMENT PUMPS

FIELD OF THE INVENTION

The present invention relates to a control device for positive displacement pumps, e.g., for vane cell pumps. In this device, a pressure space is connected via a throttle device to an outlet connected to a consumer. A flow control piston is also provided, which is displaceable in a housing bore and the first end face of which has a connection to the pressure space. A second end face of the flow control piston projects into a chamber which is connected to the outlet downstream of the throttle device. Depending on a differential pressure acting on the two end faces, the flow control piston opens a connection from the pressure space to a pump inlet duct. The throttle device is located in the pressure output of the pump and includes a control pin, the control contour of which is configured so that, together with a throttling bore, a modifiable passage cross-section is brought about. In this connection, one of the two elements, control pin and throttling bore, is connected to the flow control piston, and the other of the two elements is fixed in relation to the housing.

BACKGROUND INFORMATION

Such a control device interacting with a throttle device is described in German Published Patent Application No. 22 30 306. The pump is given a sloping flow characteristic by a stud of the control pin, which stud is conical at its free end. In such control devices, there is a risk of an excessive increase in delivery rate occurring when the pump undergoes a speed increase from the proportional range (for example no-load range) to the control range. This can be felt as a distinct drop and subsequent equally distinct rise in steering torque. If an additional pressure-limiting valve is installed in such a control device, there is then moreover an excessive increase in maximum pressure when this pressure-limiting valve responds.

It is an object of the present invention to provide a control device, with which such an overshoot, i.e., a brief excessive increase in the delivery capacity or the delivery pressure, on rapid acceleration from very low speeds may be prevented.

SUMMARY

The above and other beneficial objects of the present invention are achieved by providing a control device as described herein by virtue of the fact that, in an axial. displacement region which, at the flow control piston, is not yet used for volume flow control, the control pin has a thickened portion, so that a minimal aperture cross-section exists in this displacement region. This results in the pressure difference across the thickened region being greater and the flow control piston moving earlier, or more rapidly in the case of dynamic operations.

Example embodiments of the present invention are described herein. The control pin with its thickened portion may be manufactured especially simply if the control pin is connected to the flow control piston and the throttling bore is fixed in relation to the housing, and the thickened portion is of cylindrical configuration. For better fine-adjustment of the control characteristic,-the thickened portion may have a frustoconical contour. In this connection, the larger diameter of the cone frustum may be arranged on the first end face of the flow control piston. In this manner, the characteristic of the control operation, the control speed, may be adjusted very finely.

The present invention is explained in greater detail below with reference to two example embodiments illustrated in the Figures. The vane cell pump illustrated and described represents only an example of application of the control device according to the present invention. Instead of this, a roller cell pump or another positive displacement pump may be provided with a control device according to the present invention.

DETAILED DESCRIPTION

Figure 1:
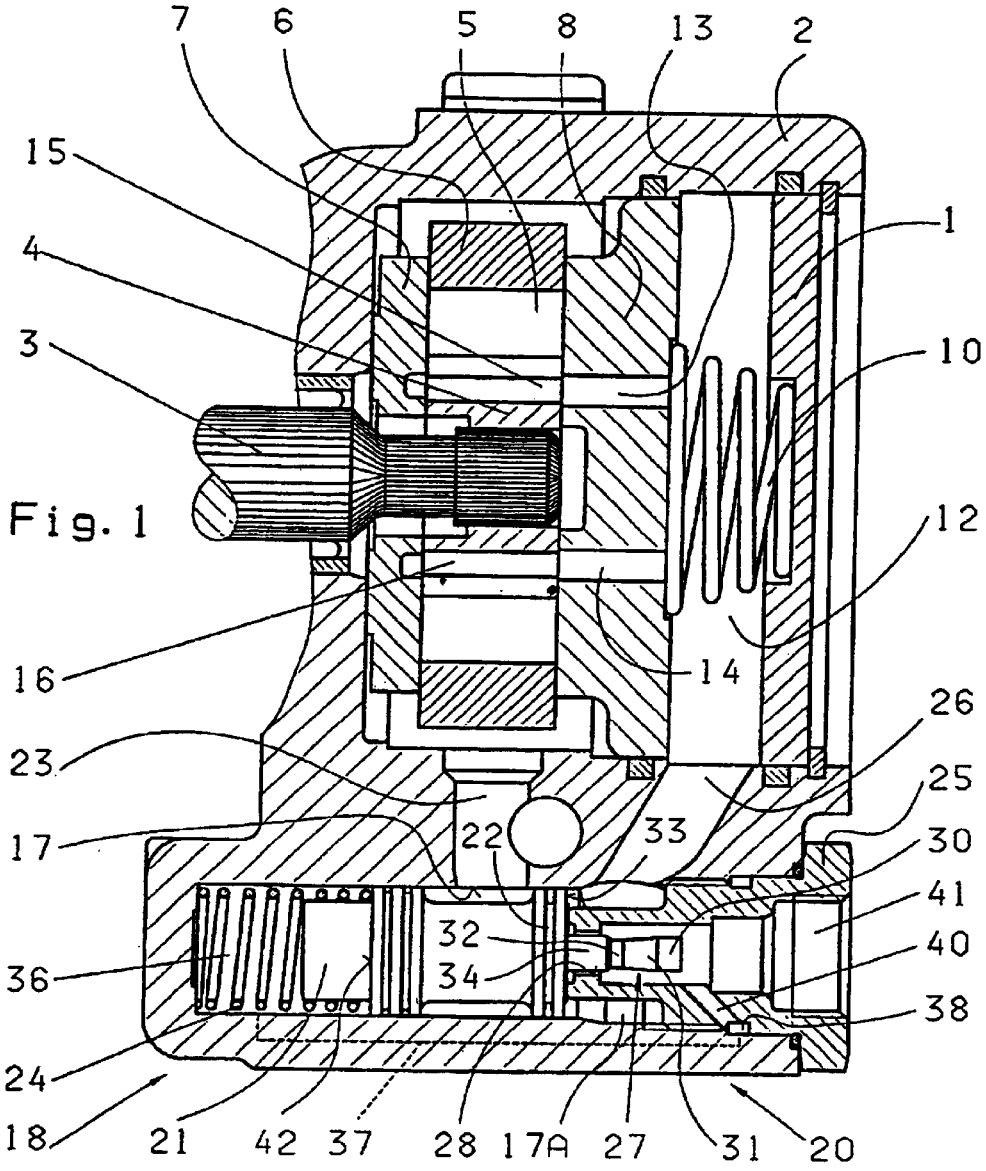
FIG. 1 illustrates a control device for a vane cell pump in longitudinal section according to a first example embodiment of the present invention.

A drive shaft 3 is mounted in a housing 2 closed by a cover 1.

In a conventional manner, the .drive shaft 3 bears a rotor 4 on splining.

Guided in radial slots of the rotor 4 are radially movable vanes 5 which slide sealingly along a cam ring 6. A pressure plate 7 bears sealingly against the pump assembly consisting of the rotor 4, the vanes 5 and the cam ring 6. A further pressure plate 8 bears against the pump assembly on the other side by virtue of the force of a spring 10. The vanes 5 enclose delivery chambers between them, which are connected to a suction connection. The pressure oil delivered emerges from the delivery chambers via pressure openings of the pressure plate 8 into a pressure chamber 12. The pressure chamber 12 has a connection to undervane spaces 15 and 16 via part-ring-shaped ducts 13 and 14. In this manner, it is possible to press the vanes 5 passing through the pressure zone at any one time outwardly into the cam ring 6.

In a housing bore 17 in—in the drawing—the lower part of the pump, a flow control valve 18 and a throttle device 20 are installed coaxially with one another. A flow control piston 21 of the flow control valve 18 controls an inlet duct 23 of the pump, in a conventional manner, with a control collar 22. In the initial position depicted, the control collar 22, loaded by a spring 24, bears against the throttle device 20. In this connection, the inlet duct 23 is closed by the control collar 22. In a bore portion 17A arranged to the right of the control collar 22, a closing element 25, for example, a pipe union, is located, which is connected to a consumer, for example, servo power steering. A supply duct 26 joins the pressure chamber 12 to the bore portion 17A.

The throttle device 20 includes a control pin 27 which is connected firmly to the flow control piston 21, and a throttling bore 28 which is arranged on the closing element 25 and is thus connected firmly to the housing 2. The two elements, control pin 27 and throttling bore 28, may also each be connected to the other elements, housing 2.and flow control piston 21, with the same effect.

At its free end, the control pin 27 has a contour which allows the delivery flow conducted to the consumer to be influenced in a speed-dependent manner. In the example embodiment, this contour includes an essentially cylindrical end portion 30 which is followed by a conical portion 31 and a portion 32 of smallest cross-section. According to the present invention, a thickened portion 34 of the control pin 27 is located between this portion 32 and a first end face 33 of the flow control piston 21, which end face faces the throttle device 20. The thickened portion 34 extends over such an axial length that, when the flow control piston 21 is displaced by a travel corresponding to this length, no volume flow control occurs yet. This means that, after such displacement, no connection yet exists between the supply duct 26 coming from the pressure chamber 12 and the inlet duct 23.

Figure 2:
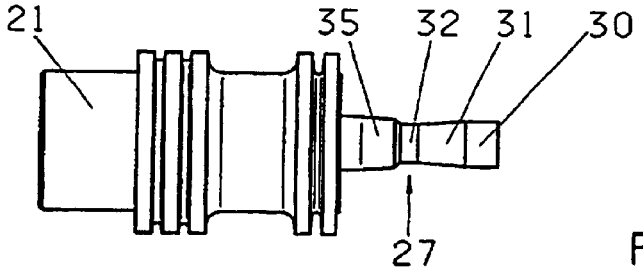
FIG. 2 illustrates a flow control piston of the control device according to a second example embodiment of the present invention.

In the example embodiment illustrated in FIG. 1, the thickened portion 34 has a cylindrical contour. In the example embodiment illustrated in FIG. 2, the thickened portion 35 has a frustoconical contour. In this connection, the larger diameter of the cone frustum is arranged on the first end face 33 of the flow control piston 21. The characteristic of the control operation, the control speed, may thus be adjusted very finely.

A space 36 accommodating the spring 24 of the flow control piston 21 is connected, via a control line 37 indicated by a broken line, an annular groove 38 and a throttling location 40, to an outlet 41 which is arranged on the closing element 25. In certain example embodiments, the annular groove 38 and the throttling location 40 may be omitted. The space 36 is delimited on one of its sides by a second end face 42 of the flow control piston 21.

The control device works in the following manner. The entire delivery flow of the pump flows firstly via the supply duct 26 into the bore portion 17A. Up to the limit point at a pump speed of, for example, 1000/mm, the delivery flow flows past the end face 33 of the control collar 22 to the outlet 41. The delivery flow flows through the passage cross-section depicted, between the control pin 27 and the throttling bore 28. In this connection, due to the pressure drop which arises, the flow control piston 21 is displaced slightly to the left, the control collar 22 nevertheless not yet commencing the opening of the inlet duct 23. Due to the throttling cross-section between the thickened portion 34 and the throttling bore 28, which is kept very small, a great pressure difference arises across the throttle device 20 and thus across the flow control piston 21. This great pressure difference forces an accelerated movement of the flow control piston 21. This in turn leads to a more rapid reaction of the control mechanism, so that an overshoot and an excessive increase in the delivery capacity may be prevented.

Reference Numbers

1 cover
2 housing
3 drive shaft
4 rotor
5 vane
6 cam ring
7 pressure plate
8 pressure plate
9 —
10 spring
11 —
12 pressure chamber
13 part-ring-shaped duct
14 part-ring-shaped duct
15 undervane space
16 undervane space
17 housing bore
17A bore portion
18 flow control valve
19 —
20 throttle device
21 flow control piston
22 control collar
23 inlet duct
24 spring
25 closing element
26 supply duct
27 control pin
28 throttling bore
29 —
30 end portion
31 conical portion
32 portion of smallest diameter
33 first end face
34 thickened portion
35 thickened portion (conical)
36 space
37 control line
38 annular groove
39 —
40 throttling location
41 outlet
42 second end face

What is claimed is:

1. A control device for a positive displacement pump, comprising:

a throttle device configured to connect a pressure space of the pump to an outlet connected to a consumer; and a flow control piston displaceably arranged in a housing bore, the flow control piston including a first end face connected to the pressure space and a second end face configured to delimit a space connected to the outlet, the flow control piston configured to open a connection from the pressure space to an inlet duct of the pump in accordance with a differential pressure acting on the first end face and the second end face;

wherein the throttle device is arranged in a pressure output of the pump and includes a control pin, having a control contour configured to cooperate with a throttling bore to define a modifiable passage cross-section, a first one of the control pin and the throttling bore connected to the flow control piston, a second one of the control pin and the throttling bore fixed in relation to the housing; and wherein the throttle device includes an axial displacement region not used for volume flow control having a thickened portion so that a minimal aperture cross-section is arranged in the axial displacement region.

2. The control device according to claim 1, wherein the positive displacement pump includes a vane cell pump.

3. The control device according to claim 1, wherein the control pin is connected to the flow control piston, the throttling bore fixed in relation to the housing.

4. The control device according to claim 3, wherein the thickened portion of the control pin includes a cylindrical contour and is arranged on the first end face of the flow control piston.

5. The control device according to claim 3, wherein the thickened portion of the control pin includes a frustoconical contour, a larger diameter of a cone frustum arranged on the first end face of the flow control piston.

* * * * *